United States Patent [19]

Ryzner

[11] Patent Number: 4,683,806

[45] Date of Patent: Aug. 4, 1987

[54] PISTON GUIDE FOR HOLLOW PISTON OF A RADIAL PISTON ENGINE

[75] Inventor: Clemens Ryzner, Sprockhovel, Fed. Rep. of Germany

[73] Assignee: Paul Maschinenfabrik GmbH & Co. KG, Witten, Fed. Rep. of Germany

[21] Appl. No.: 762,783

[22] Filed: Aug. 6, 1985

[30] Foreign Application Priority Data

Aug. 17, 1984 [DE] Fed. Rep. of Germany ..... 3430362

[51] Int. Cl.[4] ..... F01B 15/00

[52] U.S. Cl. ..... 92/66; 92/72; 92/118; 92/167; 91/494; 417/464; 417/467

[58] Field of Search ..... 91/486, 488, 491–495; 92/58, 72, 118, 119, 66, 167; 417/273, 464, 467

[56] References Cited

U.S. PATENT DOCUMENTS

| | | | |
|---|---|---|---|
| 3,040,716 | 6/1962 | Hahn | 91/492 X |
| 3,168,006 | 12/1965 | Bennett | 91/495 X |
| 3,320,902 | 5/1967 | Paschke | 417/273 X |
| 3,577,830 | 5/1971 | Ortelli | 92/66 |
| 3,885,459 | 5/1975 | Freese | 92/119 |
| 3,945,766 | 3/1976 | Gelon | 417/273 |
| 3,968,736 | 7/1976 | Pecorari | 92/167 X |
| 4,469,013 | 9/1984 | Poppi | 91/495 |
| 4,527,460 | 7/1985 | Eisenbacher et al. | 417/464 |

FOREIGN PATENT DOCUMENTS

| | | | |
|---|---|---|---|
| 2013253 | 10/1970 | Fed. Rep. of Germany | 417/464 |
| 2244920 | 4/1974 | Fed. Rep. of Germany | 91/491 |

*Primary Examiner*—Carlton R. Croyle
*Assistant Examiner*—Paul F. Neils
*Attorney, Agent, or Firm*—Burns, Doane, Swecker & Mathis

[57] ABSTRACT

In a radial piston engine, in order to reduce the friction forces appearing at the pistons, a guide part is provided which engages a hollow piston through a guide section and which includes a bearing section at its outer end, by means of which the guide part is pivotably mounted in the cylinder cover.

4 Claims, 5 Drawing Figures

(A-A)

(A-A)

PISTON GUIDE FOR HOLLOW PISTON OF A RADIAL PISTON ENGINE

BACKGROUND OF THE INVENTION

The invention relates to a radial piston engine according to the pre-characterizing clause of claim 1.

A radial piston engine of this type is known from German Auslegeschrift No. 2,244,920. In order to guide the pivotal movement and stroke movement in the cylinders of the hollow pistons in contact with the eccentric, the pistons are each slidable in the axial direction in the bushing which is provided with a spherical surface on the external circumferences and is mounted in a corresponding bearing shell inserted in the cylinder. Due to design considerations, the spherical bearing bushing can only be constructed as a relatively narrow section. The incident operating pressure presses the externally spherical bearing bushing into the inner section of the bearing shell, whereby a surface pressure results between bushing and bearing shell which is several times greater than the incident operating pressure. Consequently substantial forces which result from the high surface pressure of the bearing bushing in the bearing shell have to be overcome during the operation of the engine. There are also, resulting from this, high edge forces on the pistons due to a relatively short guided length, which in turn influence the friction forces in the longitudinal movement of the piston. The efficiency of the engine is influenced substantially by these forces which have to be overcome.

OBJECT AND SUMMARY OF THE INVENTION

The underlying object of the invention is to construct a radial piston engine of the type initially stated so that the surface pressure between the moving parts is reduced and the introduction of forces to the pistons occurs under favorable conditions.

This object is achieved by the features in the characterizing clause of claim 1. Due to the guide part dipping into the hollow piston, and mounted pivotably in the cylinder by its outer end, a configuration of the bearing means is possible which is exposed only to a weak surface pressure or is totally balanced hydraulically. Consequently no appreciable edge forces are introduced from the bearing means into the piston, so that the latter can be prevented in a simple manner from gaping on the circumference of the eccentric.

It is possible to mount the guide part pivotably by means of articulating pins about an axis of articulation in the cylinder oriented parallel to the axis of the eccentric, however a ball and socket joint type of bearing means as disclosed in claim 2 is preferably provided.

Other advantageous further developments of the invention are disclosed in the remaining claims and in the following description.

DESCRIPTION OF THE DRAWING

An example of a form of construction of the invention is discussed in detail below with reference to the drawing, wherein.

DETAILED DESCRIPTION OF THE PREFERRED EMBODIMENT

Figure 1A:
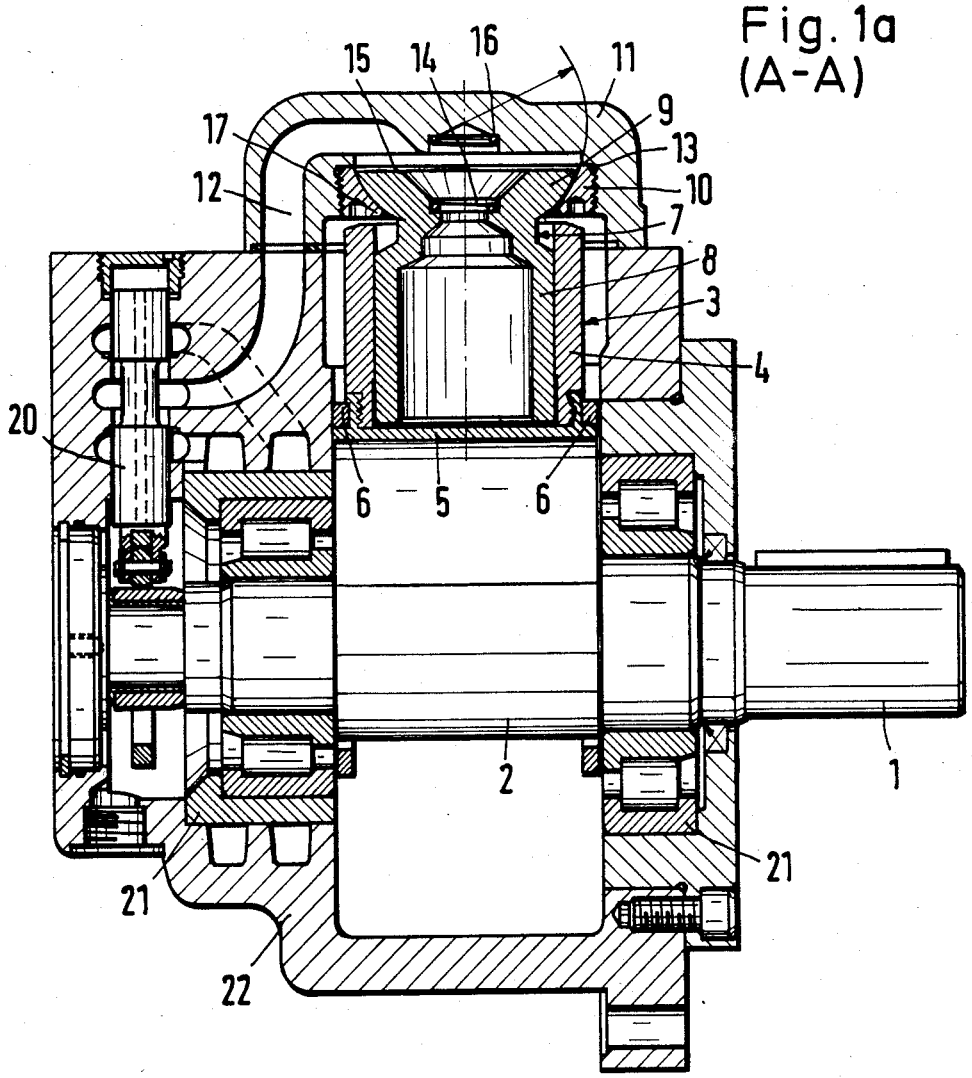
FIG. 1*a* shows a longitudinal section through a radial piston engine with pistons and guide part showing a first form of construction of the guide part.

FIG. 1 shows an output shaft 1 with an eccentric 2, the circumference of which is contacted by, for example five hollow pistons 3 of which only one is illustrated in the top dead center position in FIG. 1. In this form of construction the hollow piston 3 consists of a cylindrical sleeve 4 which is connected to a piston foot 5. It is also possible to construct the piston with piston foot as one piece. The pistons 3 are guided positively on the circumference of the eccentric by rings 6 which engage over a lateral prolongation of the piston foot.

Figure 1B:
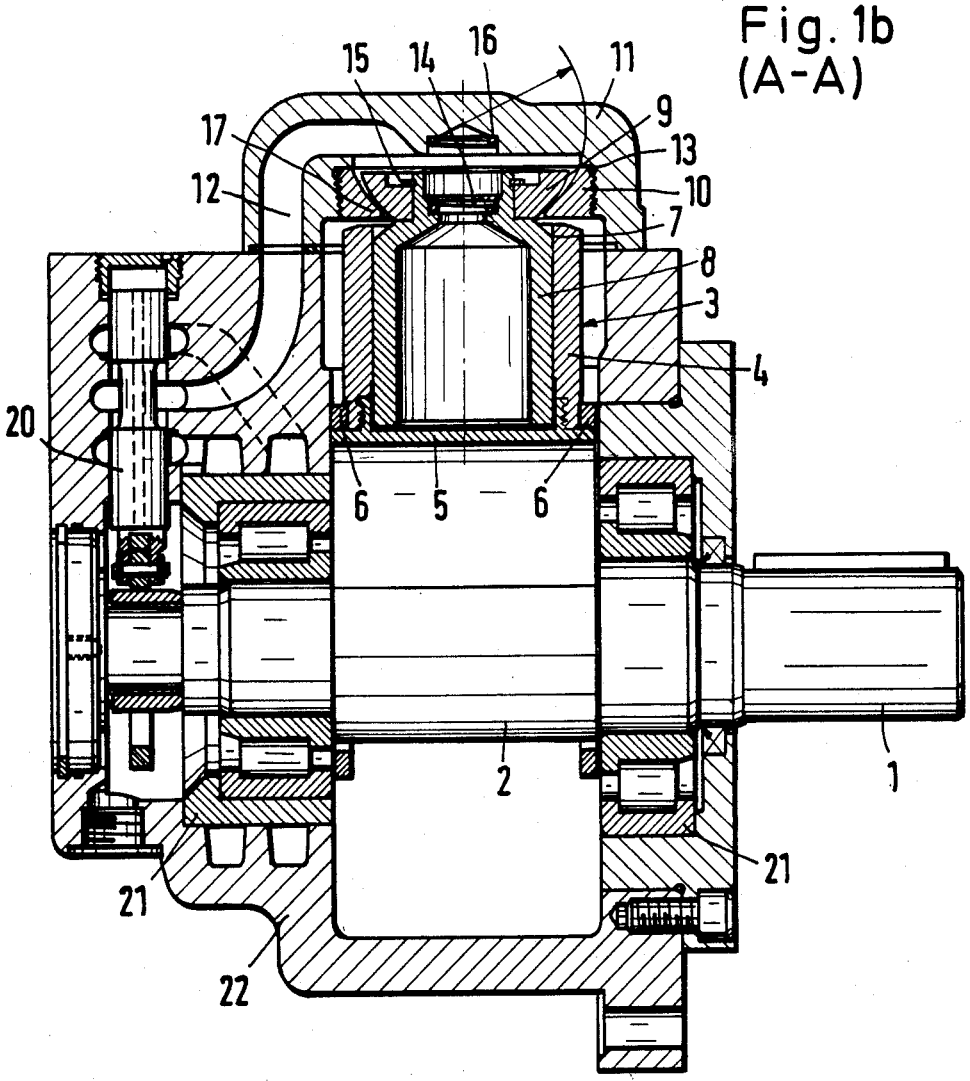
FIG. 1*b* shows a longitudinal section through a radial piston engine with pistons and guide part showing a second form of construction of the guide part.
Figure 2:
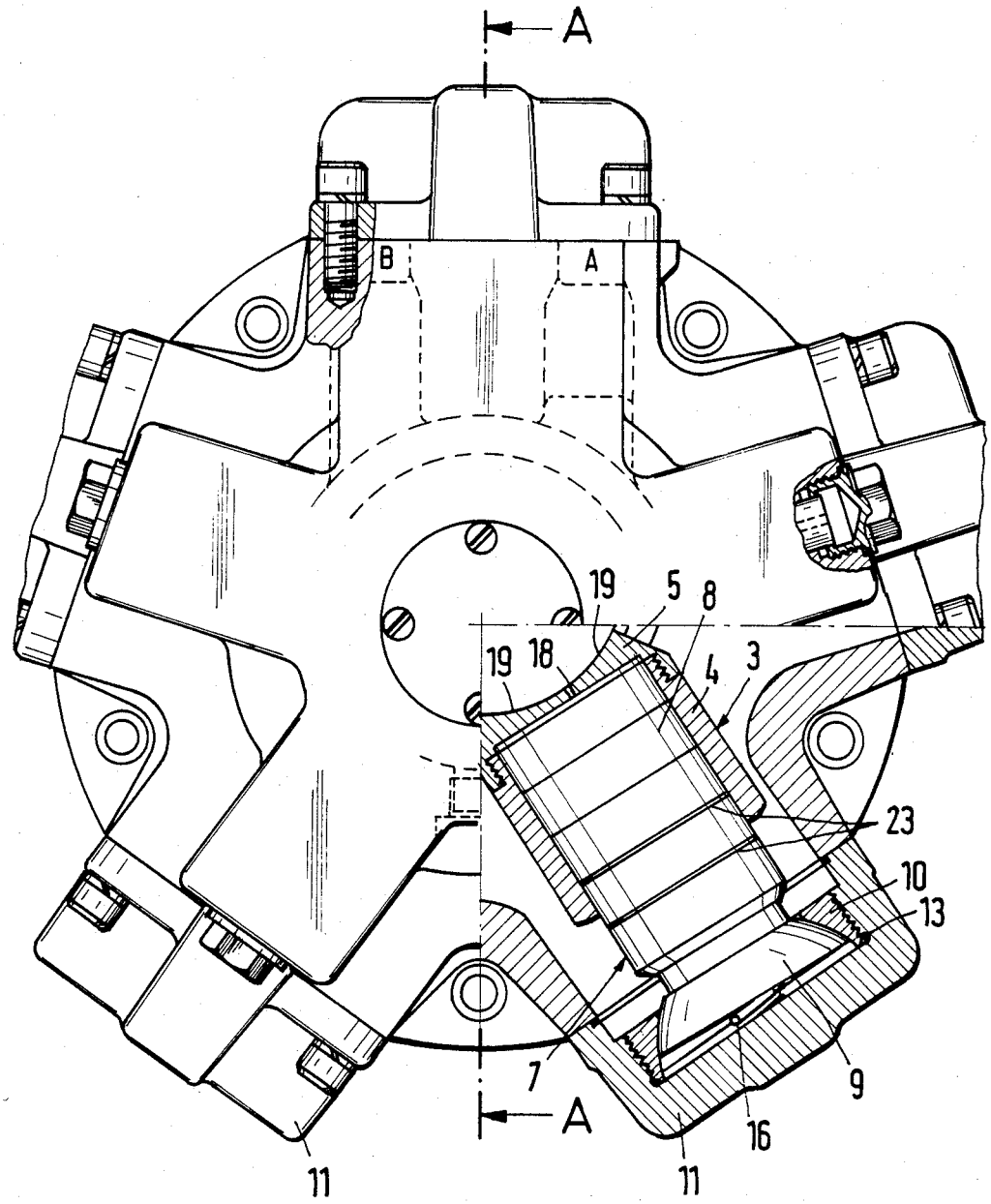
FIG. 2 shows, partly in section, an end elevation of the radial piston engine.
Figure 3:
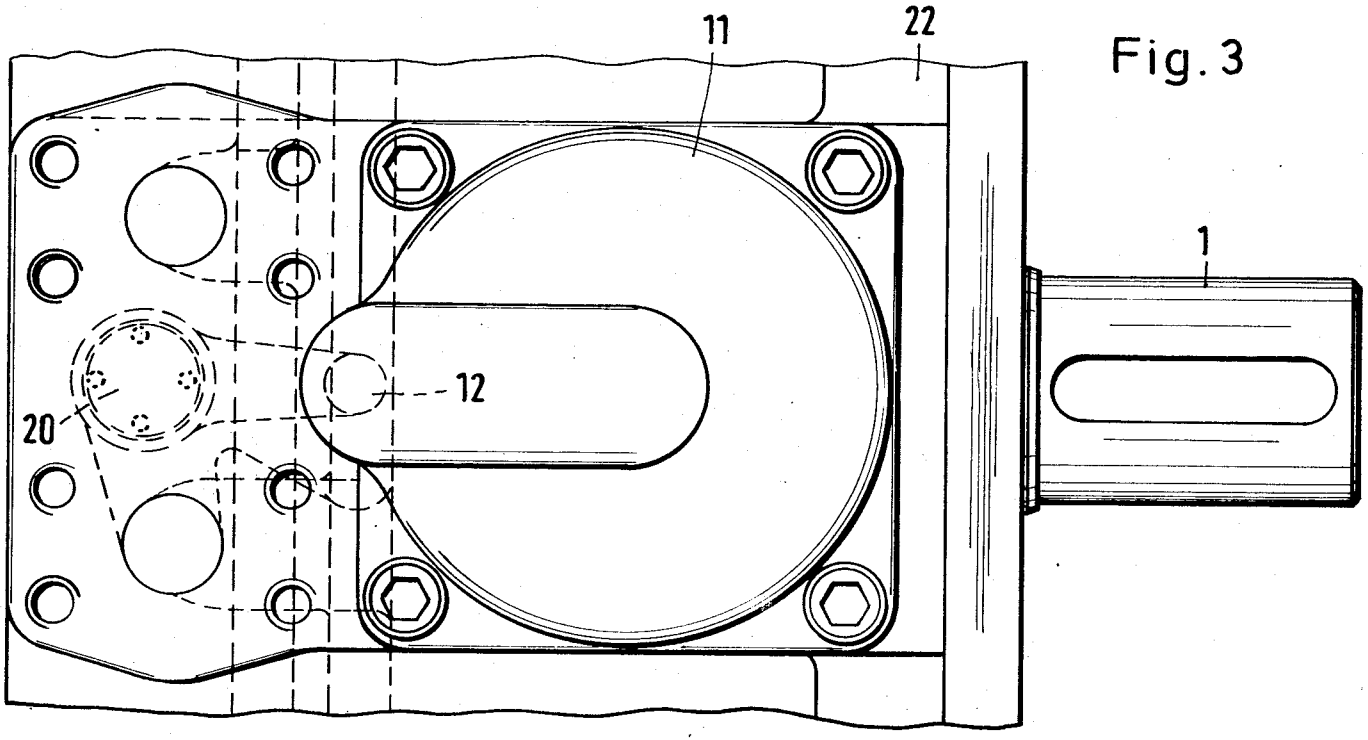
FIG. 3 shows a plan view of a cylinder.

A guide part 7, which is illustrated in two different forms of construction in FIGS. 1*a* and 1*b*, is slidable in each of the hollow pistons 3. FIG. 1*a* shows a guide part 7 consisting of one piece with a hollow cylindrical section 8 which engages into the hollow piston 3, and with a spherical-outline, annular section 9 at the outer end, which forms the bearing means for the pivotal movement of the guide part 7. FIG. 2 shows the guide part 7 in a pivotal position near the bottom dead center of the piston stroke. The bearing section 9 with its spherical-outline annular external surface is located in a bearing shell 10 which is screwed into the cover 11 of the cylinder. The pipe constructed in the cylinder cover 11 to load the piston with pressurised medium is designated 12 in FIGS. 1*a* and 1*b*. The bearing shell 10 is screwed tightly in the cylinder cover 11 by means of a seal ring 13, so that the cylinder cover 11 and the bearing shell 10 forms a unit exposed only to internal forces. The forces acting upon the cylinder cover upon loading with pressurized medium are therefore relatively weak, so that it is possible to fasten the cylinder cover to the housing with only four screws, as FIG. 3 shows, whereas a large number of screws is necessary to fasten the cylinder cover in the known forms of construction. This results in a considerable simplification of production and therefore a reduction of manufacturing costs.

In the case of the design of the guide part 7 illustrated in FIG. 1*b*, the diameter of the bore in the bearing shell 10 is dimensioned so that the cylindrical section 8 of the guide part 7 can just be pushed through this bore. Therefore, due to the operating pressure which is applied via the pipe 12, there remains on the guide part 7 a force in the direction of the spherial bearing shell 10 which cannot be balanced and produces a surface pressure between the ball section 9 of the guide part 7 and bearing shell 10. However, because the surfaces exposed to the surface pressure can be made large and also the force direction through the central recess 14 in the guide part 7 is directed rather radially, a correspondingly weak surface pressure is obtained with favorable friction conditions.

In the case of the configuration of the guide part 7 according to FIG. 1*b*, the forces between guide part 7 and bearing shell 10 are totally balanced. In this two-piece configuration the ball section 9 is fastened by means of a circlip 15 upon the otherwise cylindrical guide part 7 which is provided with a corresponding shoulder. By this means the bore diameter of the bearing shell 10 can be dimensioned smaller than the external diameter of the cylindrical section 8 of the guide part 7. Although the pressurized medium supplied through the pipe 12 loads the top side of the spherical section 9, it passes through the central perforation 14 likewise onto the underside of the cylindrical section 8 of the guide part 7, so that these forces cancel each other in the case of appropriate dimensioning of the opposite surfaces. The cylindrical section 8 of the guide part 7 is dimensioned so that a small interval is still present between the lower end face of the guide part 7 and the piston head in the top dead center position illustrated in FIGS. 1*a* and 1*b*. The surface of the piston 3 which is loaded by pressurized medium then corresponds to the internal diameter of the piston sleeve 4. A compression spring 16, which is arranged between cylinder cover 11 and guide part 7, ensures a reliable contact of the guide part 7 in the bearing shell 10 at all times. This compression spring is also provided in the case of the form of construction corresponding to the guide part 7 in FIG. 1*a*. In the bearing shells 10 the spherical bearing surface is constructed only on an annular section 17, as FIGS. 1*a*, 1*b* show. The remaining internal surface of the bearing shell 10 is constructed so that it is located at an interval from the spherical external surface of the bearing section 9, so that the pressurized medium can penetrate into this region between bearing shell 10 and bearing section 9.

In the form of construction corresponding to the guide part 7 in FIG. 1*b*, the external diameter of the annular bearing surface 17 in the bearing shell 10 corresponds to the external diameter of the cylindrical section 8 of the guide part, whereas in the form of construction corresponding to FIG. 1*a*, the internal diameter of the annular bearing surface 17 corresponds substantially to the external diameter of the cylindrical section 8. Consequently a surface pressure which results from the annular surface 17 and the pressure of the work medium is present in the case of the form of construction of FIG. 1*a*.

Due to the weak friction forces of the bearing means of the guide part 7 in the bearing shell 10 in combination with the longitudinal guidance of the hollow piston 3 on the cylindrical section 8 of the guide part 7, only very weak edge forces result at the piston 3, which keep the friction between cylindrical section 8 and piston sleeve 4 low on the one hand, and do not create the danger of the piston shoe gaping from the circumference of the eccentric on the other hand. This is the case particularly for the configuration corresponding to the guide part 7 in FIG. 1*b*, in which the surface pressure and therefore the friction in the bearing shell results solely from the contact pressure of the spring 16.

As FIG. 2 shows, a throttle bore 18 is constructed in the piston shoe, through which work medium can penetrate into cavities 19 constructed on both sides of the center line in the piston shoe, in order to effect the lubrication of the piston shoe on the eccentric and the hydrostatic relief of the piston.

This configuration is known per se, as are also the remaining components of the radial piston engine, such as the control slide 20 in FIG. 1*a*, 1*b*, bearing 21 of the output shaft 1 in the housing 22, so that there is no need to discuss these components further.

Figure 4:
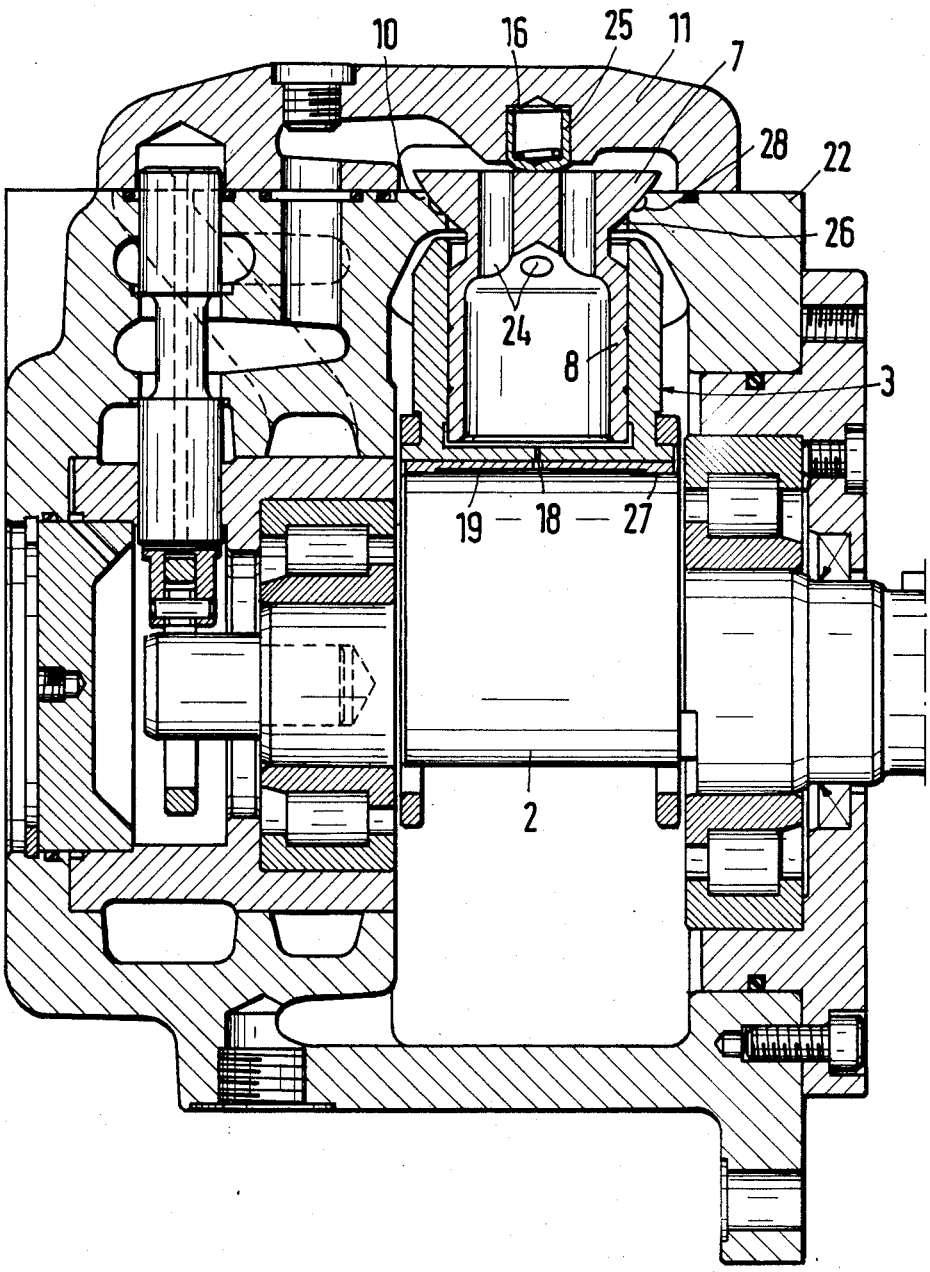
FIG. 4 shows a longitudinal section through a variant form of construction.

FIG. 4 shows a longitudinal section through a variant form of construction, in which the spherical-outline annular bearing shell 10 for the guide part 7 is constructed in the top part of the cylinder or the housing 22. The guide part 7 is provided with perforations 24 of annular arrangement. The compression spring 16 braced against the cylinder cover 11 engages over a pot-shaped spring washer 25 on the central part of the guide part 7. The external diameter of the cylindrical section 8 of the guide part 7 is somewhat smaller than the bore 26 in the top part of the housing. With this configuration the cylinder cover 11 is not relieved, nevertheless a favorable manufacturing cost is obtained by this mode of construction.

In the form of construction according to FIG. 4, a slip layer 27 is constructed on the bottom side of the piston shoes, by means of which the piston 3 slides on the eccentric 2. This slip layer 27 is likewise provided with the throttle bore 18 and with the balancing cavities 19.

The pivot bearing means of the guide part 7 dipping into the hollow piston 3 may also be constructed otherwise than as illustrated. The form of construction illustrated with a spherical-outline annular surface has the advantage that the dead space above the piston can be reduced to a minimum. Another factor in a compact construction is that the length of the piston sleeve 4 can be dimensioned relatively short because it is required only for axial guidance in combination with the cylindrical section 8 of the guide part 7, and the pivot bearing means is located outside the piston. In a variant mode of construction of the pivot bearing means of the guide part 7, an axis of articulation parallel to the axis of the eccentric may be provided with corresponding articulating pins in the cylinder cover 11 or in the top part of the housing. It is also possible to dimension the ball and socket joint bearing means of the guide part 7 in the cylinder cover 11 or in the top part of the housing with a smaller spherical radius than illustrated. Due to the fact that the pivot bearing means is separate from the piston, no design limitations arise in the dimensioning of the pivotal bearing means, particularly if the guide part 7 is constructed of two or more parts.

Grooves on the circumference of the guide section 8 of the guide part 7 which serve for lubrication, are designated 23 in FIG. 2. Instead of the illustrated configuration of the guide part 7 with a substantially hollow cylindrical shape, another configuration, somewhat stellate in cross-section, for example, may be provided, in which the passage of the work medium from the loading side as far as the piston end, and simultaneously the axial guidance of the hollow piston on its inside, is likewise ensured.

Whereas in the form of construction according to FIG. 1*a*, 1*b*, the spherical bearing surface is constructed only on a narrow annular section 17, a wider bearing surface, in which lubrication grooves 28 are constructed, is provided in the case of the form of construction according to FIG. 4.

It is of course possible to embody the invention in other specific forms than those of the preferred embodiment described above. This may be done without departing from the essence of the invention. The preferred embodiment is merely illustrative and should not be considered restrictive in any way. The scope of the invention is embodied in the appended claims rather than in the preceding description and all variations and changes which fall within the range of the claims are intended to be embraced therein.

I claim:

1. A radial piston engine comprising:

an output shaft, an eccentric mounted on said output shaft and having a circumferential surface, a housing at least one hollow piston of pot-shaped construction having one closed end and a cavity in a central portion therein, said piston being mounted on said circumferential surface of said eccentric, such that said cavity opens radially outwardly, said piston being slidably mounted in said housing, hollow guide means positioned in said housing and cooperating with said piston, said guide means including a cavity engaging portion and a mounting portion to pivotably mount said guide means in said housing, said mounting portion including a spherical bearing surface on the radial outer end of said guide means, said bearing surface being directed radially inward, a bearing shell including an annular seat for receiving said bearing surface of said guide means, the annular seat being directed radially outward and having a spherical outline external shape, and biasing means to bias said bearing surface of said guide means against said seat of said bearing shell.

2. The radial piston engine according to claim 1, wherein:

said guide means is of one-piece construction and said cavity engaging portion of said guide means includes an external diameter, and said bearing shell includes an internal diameter which corresponds to said external diameter of said cavity engaging portion of said guide means.

3. The radial piston engine according to claim 1, wherein:

said guide means is of at least two piece construction, said mounting portion of said guide means being removable from said guide means, and said cavity engaging portion of said guide means includes an external diameter, and said bearing shell includes an internal diameter which is smaller than said external diameter of said cavity engaging portion.

4. The radial piston engine according to claim 1, further comprising a cover having a section with a bore therethrough, said bearing shell being inserted in said bore and being held thereby.

* * * * *